US007319287B2

(12) United States Patent
Ahn

(10) Patent No.: US 7,319,287 B2
(45) Date of Patent: Jan. 15, 2008

(54) ELECTRON EMISSION DEVICE WITH GRID ELECTRODE

(75) Inventor: Sang-Hyuck Ahn, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 197 days.

(21) Appl. No.: 10/999,107

(22) Filed: Nov. 29, 2004

(65) Prior Publication Data

US 2006/0033414 A1 Feb. 16, 2006

(30) Foreign Application Priority Data

Nov. 27, 2003 (KR) ..... 10-2003-0085139

(51) Int. Cl.
*H01J 1/46* (2006.01)

(52) U.S. Cl. ..... 313/299; 313/495; 313/497; 313/293; 313/296

(58) Field of Classification Search ..... 313/293, 313/296, 495, 497, 299
See application file for complete search history.

(56) References Cited

U.S. PATENT DOCUMENTS 5,721,472 A * 2/1998 Browning et al. ..... 315/169.1
7,053,544 B2 * 5/2006 Kijima et al. ..... 313/495
2001/0043172 A1 * 11/2001 McGrath et al. ..... 345/75.2
2002/0017875 A1 * 2/2002 Lee et al. ..... 313/495
2005/0184220 A1 * 8/2005 Okuda et al. ..... 250/208.1

FOREIGN PATENT DOCUMENTS

JP 2002324501 A * 11/2002

* cited by examiner

*Primary Examiner*—Sikha Roy
*Assistant Examiner*—Natalie K. Walford
(74) *Attorney, Agent, or Firm*—Christie, Parker & Hale, LLP

(57) ABSTRACT

The present invention relates to an electron emission device in which a high voltage can be properly applied to anode electrodes by improving a pattern of apertures of a grid electrode to reduce a diode emission. In an exemplary embodiment of the present invention, the electron emission device includes a first substrate and a second substrate facing each other and having a predetermined gap therebetween. An electron emission unit is formed on the first substrate, and a light emission unit formed on the second substrate. A grid electrode is mounted between the first and second substrates, and has a plurality of apertures per a sub-pixel region of the electron emission unit.

20 Claims, 6 Drawing Sheets

ELECTRON EMISSION DEVICE WITH GRID ELECTRODE

CROSS-REFERENCE TO RELATED APPLICATIONS

This application claims priority to and the benefit of Korean Patent Application No. 10-2003-0085139 filed on Nov. 27, 2003 in the Korean Intellectual Property Office, the entire content of which is incorporated herein by reference.

BACKGROUND OF THE INVENTION (a) Field of the Invention

The present invention relates to an electron emission device, and in particular, to an electron emission device in which a high voltage can be applied to an anode electrode by improving a pattern of apertures of a grid electrode.

(b) Description of the Related Art

Generally, electron emission devices can be classified into two types. A first type uses a hot (or thermoionic) cathode as an electron emission region (or source) and a second type uses a cold cathode as an electron emission region (or source).

Also, in the second type of electron emission devices, there are a field emitter array (FEA) type, a surface conduction emitter (SCE) type, a metal-insulator-metal (MIM) type, a metal-insulator-semiconductor (MIS) type, and a ballistic electron surface emitting (BSE) type.

Although the electron emission devices are differentiated in their specific structure depending upon their type, they all basically have an electron emission unit placed within a vacuum vessel, and a light emission unit facing the electron emission unit in the vacuum vessel.

Generally, an FEA type electron emission device has a front substrate and a rear substrate. Electron emission regions, together with cathode electrodes and gate electrodes for emitting electrons (or electron beams) from the electron emission regions, are formed on the rear substrate. Phosphor layers, together with an anode electrode that receives high voltages for accelerating the electron beams, are formed on the surface of the front substrate facing the rear substrate.

In the FEA type electron emission device, as a high voltage is applied to the anode electrode (i.e., as the voltage applied to the anode goes up), a brightness of the electron emission device can be increased, and/or driving voltages of the electron emission device can be decreased such that the lifespan of electron emission regions of the electron emission device can be increased due to a low voltage drive condition.

However, when a high voltage is applied to the anode electrode, an arc discharge may be possible. An arc discharge can occur because a significant amount of gas is ionized in a moment of outgassing. As such, the electron emission regions and the exposed electrodes can be damaged due to the arc discharge.

Therefore, an electron emission device with a grid electrode of a mesh type has been proposed. The grid electrode is mounted between the front substrate and the rear substrate. The grid electrode has many apertures to pass electron beams and/or to focus electrons emitted from the electron emission regions. Additionally, the grid electrode helps in preventing elements from being damaged due to an arc discharge.

A conventional grid electrode has one aperture corresponding to one sub-pixel. In the context of the present invention, a sub-pixel is referred to as an intersection of one cathode electrode and one gate electrode. However, a high voltage applied to the anode electrode can still adversely affect electron emission regions of an electron emission device when the apertures of the grid electrode are too large. Thus, an outbreak of diode emission is possible. In the context of the present invention, a diode emission is referred to as an unwanted pixel illumination caused by electrons emitted at a specific sub-pixel due to a high voltage applied to the anode electrode. To prevent such diode emission, a conventional electron emission device has a limit on how high a voltage level can be applied to the anode electrode.

SUMMARY OF THE INVENTION

In one aspect of the present invention, an electron emission device is provided and to which it is possible to apply a high voltage to an anode electrode of the electron emission device. The electron emission device prevents diode emission, increases brightness, decreases driving voltage which is applied to cathode electrodes and gate electrodes of the electron emission device, and increases the lifespan of an electron emission region of the electron emission device.

In one exemplary embodiment of the present invention, the electron emission device includes a first substrate and a second substrate facing each other and having a predetermined distance therebetween. An electron emission unit is formed on the first substrate and has at least one sub-pixel region, and a light emission unit is formed on the second substrate. A grid electrode is mounted between the first and second substrates and has a plurality of apertures per the at least one sub-pixel region.

The apertures of the grid electrode corresponding to the first and second substrates may be formed randomly, and may be formed in a round shape, an elliptical shape, or a polygonal shape.

The aperture size may be about 5~40% of the size of the at least one sub-pixel region, and a longest side of the at least one apertures may be about 95~150% of a thickness of the grid electrode.

The grid electrode may be formed with a thickness of about 10~180 μm.

The first and second substrates may be formed apart at about 200~2800 μm from each other, and the second substrate and the grid electrode may be formed apart at about 1~1000 μm intervals from each other.

The electron emission unit may include an electron emission region or regions, and electrodes for controlling electron emission of the electron emission region or regions.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Exemplary embodiments of the present invention will now be described in detail with reference to the accompanying drawings.

Figure 1:
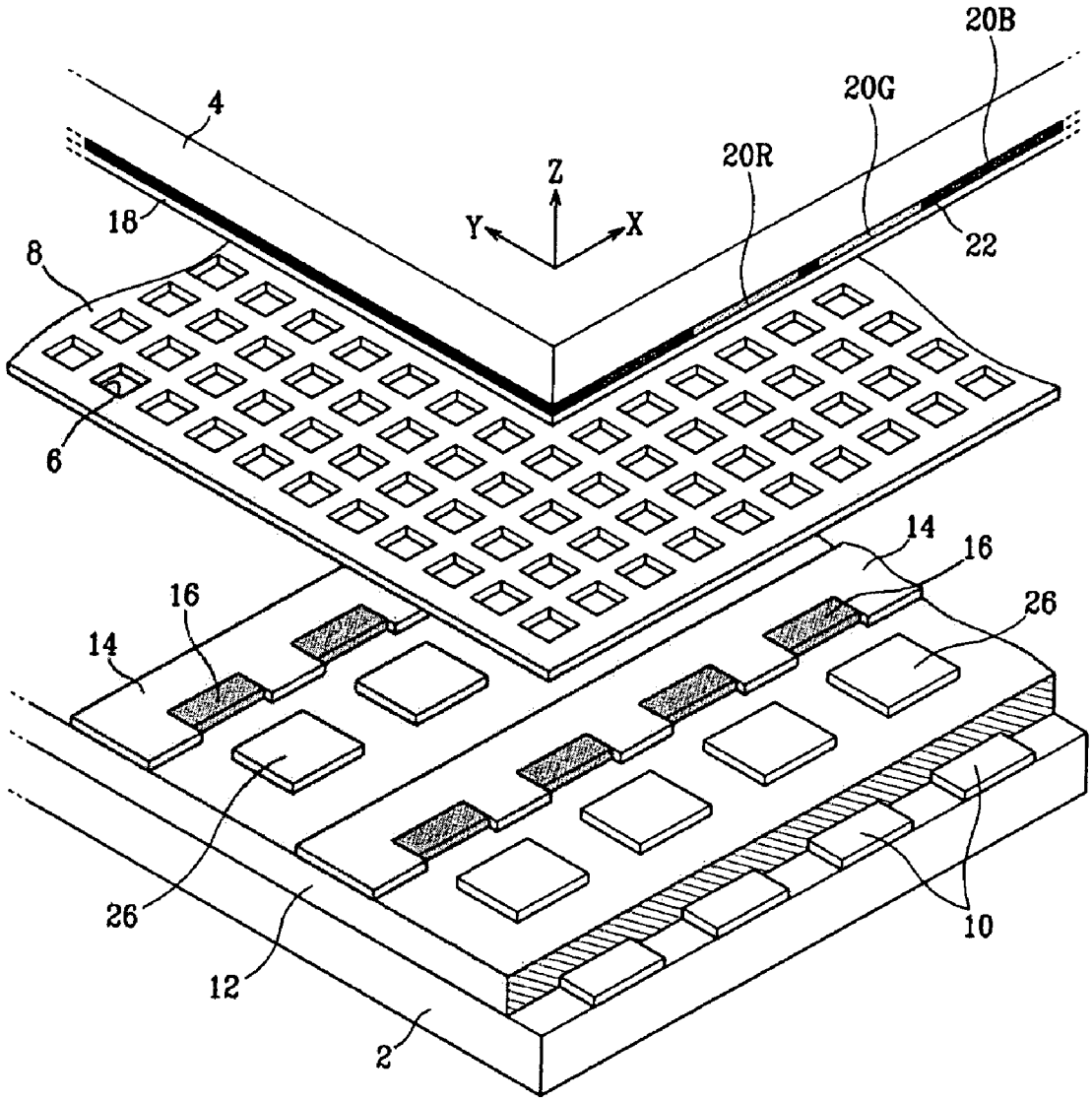
FIG. 1 is a partial exploded perspective of an electron emission device according to an exemplary embodiment of the present invention.
Figure 2A:
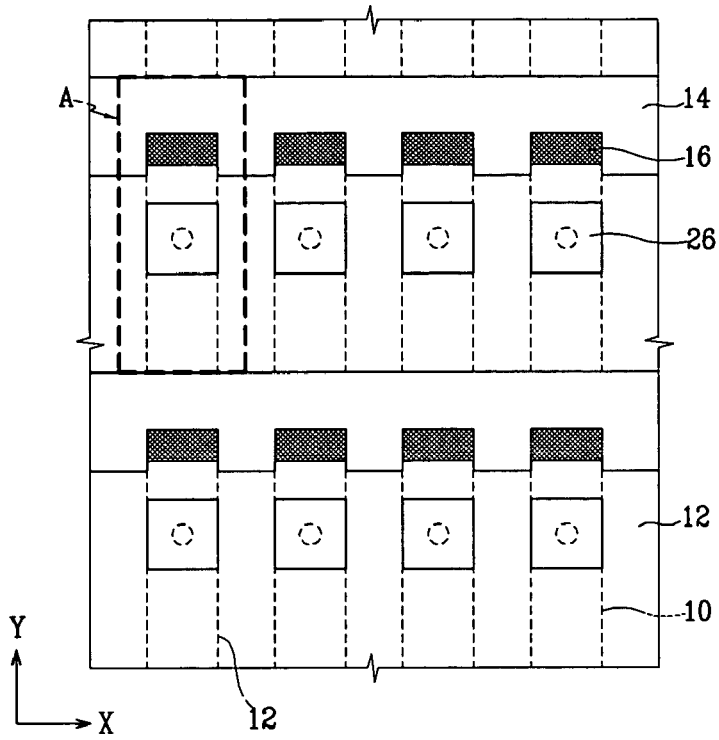
FIGS. 2A and 2B are partial plan views of a first substrate and a grid electrode of the exemplary embodiment of FIG. 1.
Figure 2B:
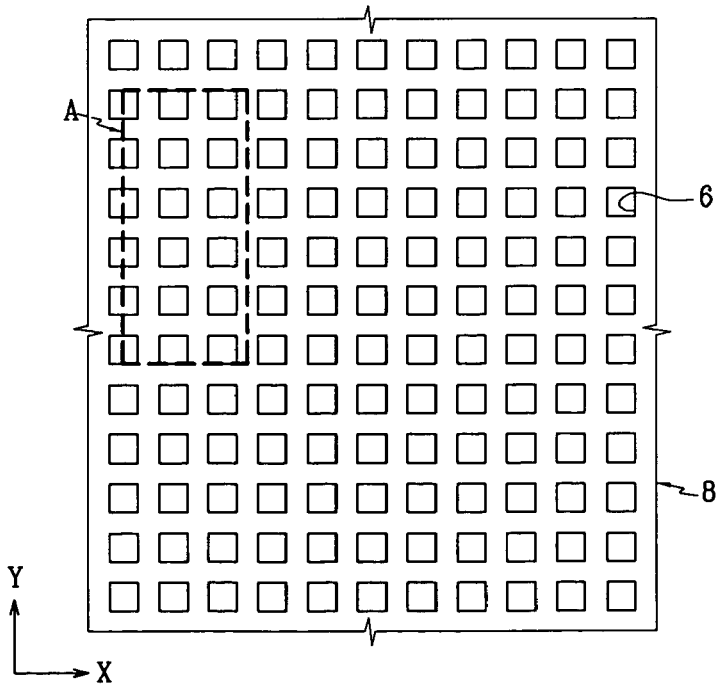
Figure 3:
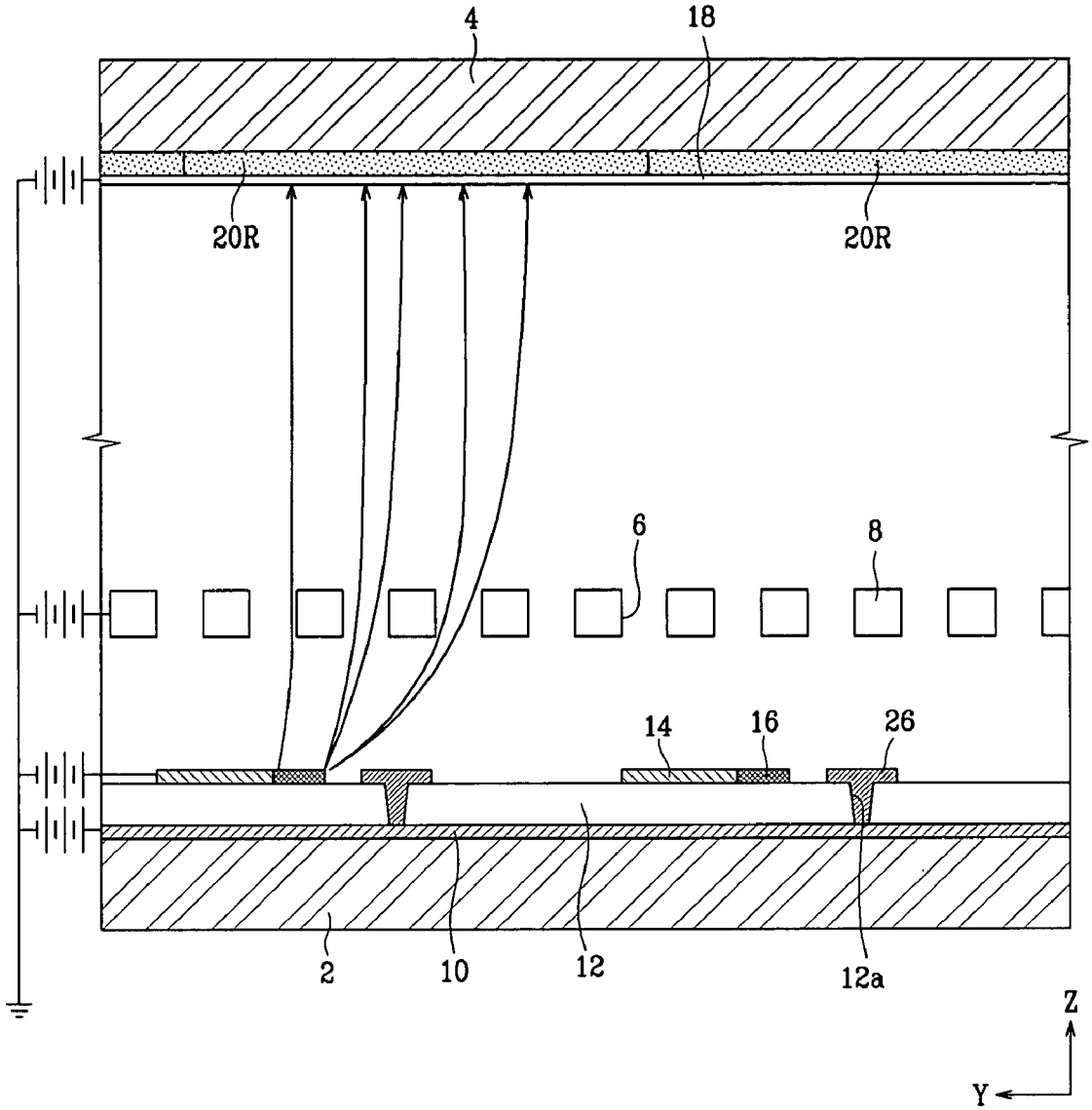
FIG. 3 is a partial sectional view of the exemplary embodiment of FIG. 1 in a state where the electron emission device of FIG. 1 is assembled.
Figure 4:
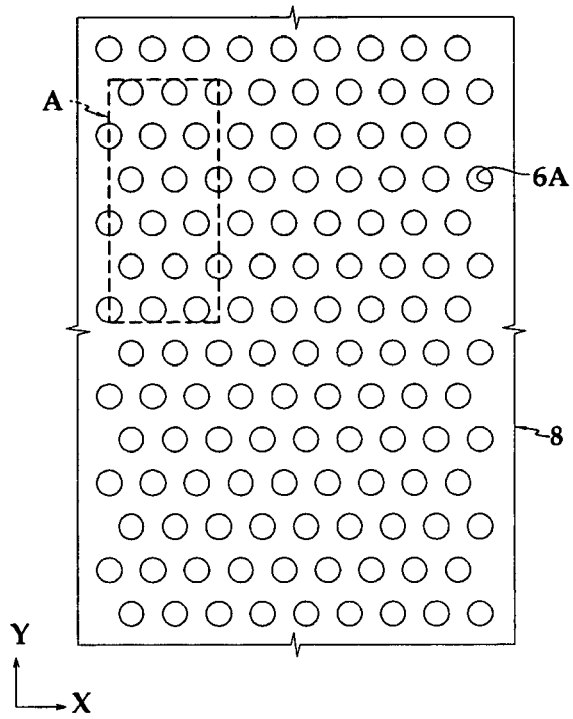
FIGS. 4, 5, 6, and 7 are schematic views of various exemplary embodiments of apertures pursuant to aspects of the present invention.
Figure 5:
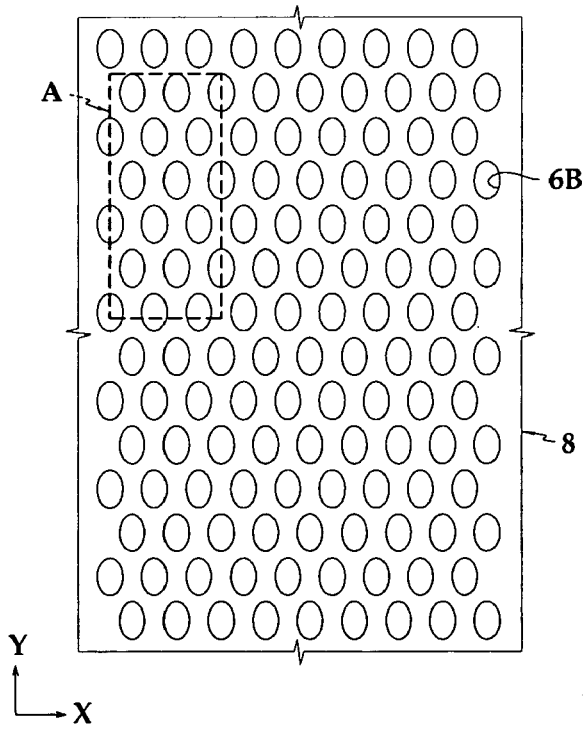
Figure 6:
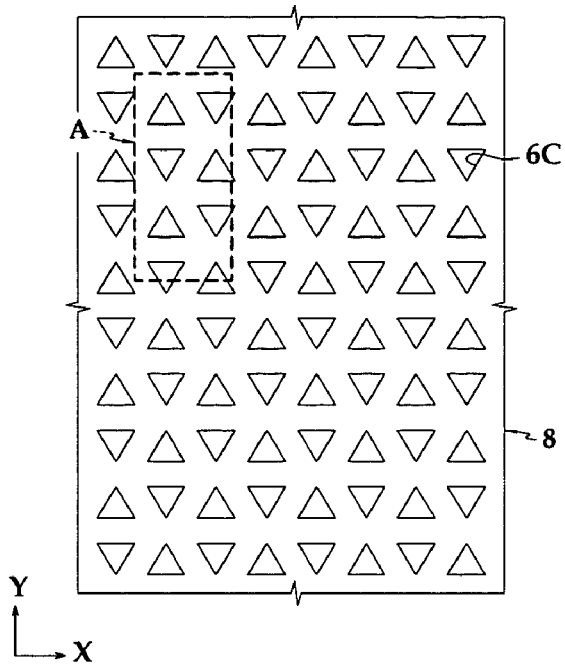
Figure 7:
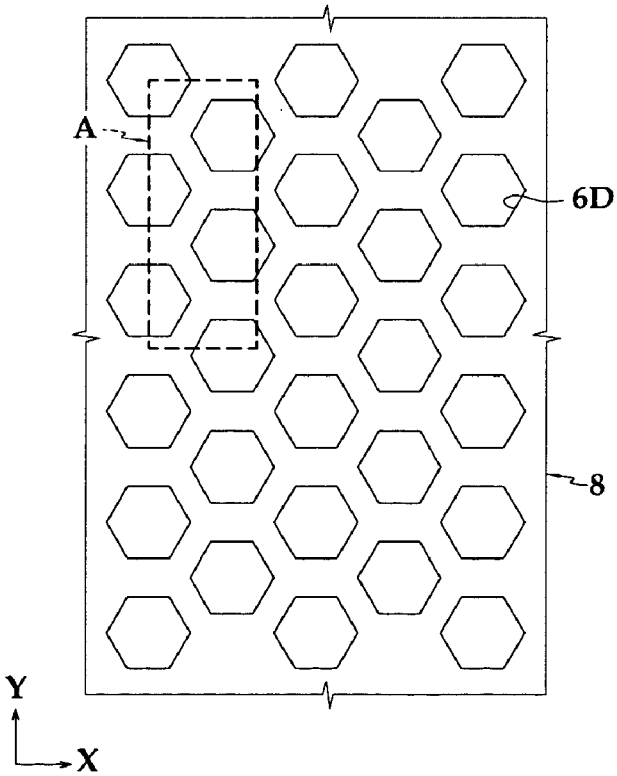

FIG. 1 is a partial exploded perspective of an electron emission device according to an exemplary embodiment of the present invention. FIGS. 2A and 2B are partial plan views of a first substrate and a grid electrode of the exemplary embodiment of FIG. 1. FIG. 3 is a partial sectional view of the exemplary embodiment of FIG. 1 in a state where the electron emission device of FIG. 1 is assembled.

As shown in FIG. 1, an electron emission device has a first substrate 2 and a second substrate 4 spaced apart from each other with a predetermined distance therebetween. The first and second substrates 2 and 4 proceed substantially parallel to each other, and are sealed to form a vacuum vessel outlining the electron emission device.

An electron emission unit is provided at the first substrate 2 to emit electrons toward the second substrate 4, and a light emission unit is provided at the second substrate 4 to emit visible light rays, thereby displaying desired images. A grid electrode 8 is mounted between the first and second substrate 2 and 4, and has a plurality of apertures per sub-pixel.

Specifically, the gate electrodes 10 are formed on the first substrate 2 with a predetermined pattern (for instance, a stripe pattern) such that they are spaced apart from each other with a distance therebetween. An insulation layer 12 is formed on the entire surface of the first substrate 2 such that it covers the gate electrodes 10. Cathode electrodes 14 are formed on the insulation layer 12 to cross the gate electrodes 10. In the context of the present invention, crossed regions of the gate electrodes 10 and the cathode electrodes 14 are referred to as sub-pixel regions.

Electron emission regions 16 are formed on one side of the cathode electrodes 14. A respective electron emission region 16 can be formed with one or more carbonaceous (or carbon-based) materials, such as carbon nanotubes, graphite, diamond, diamond-like carbon, and/or $C_{60}$ (fullerene). Also, the electron emission region 16 can be formed with one or more nano size materials, such as carbon nanotubes, graphite nano-fibers, and/or silicon nano-wires. However, the shape and the material of the electron emission regions 16 are not limited thereto.

Referring now also to FIG. 3, counter electrodes 26 are spaced apart from the electron emission regions 16 between the cathode electrodes 14, and are electrically connected to the gate electrodes 10 through holes 12*a* formed in the insulation layer 12. The counter electrodes 26 pull the voltage of the gate electrodes 10 up to the electron emission regions 16 such that a stronger electric field can be applied to the electron emission regions 16 to facilitate the emission of electrons from the electron emission regions 16.

An electron emission device of the present invention is not limited to the exemplary embodiment of FIG. 1. Alternatively, an electron emission device can employ other structures, such as cathode electrodes mounted under gate electrodes. In such a case, the gate electrodes and the insulation layer have holes partially exposing the cathode electrodes. The electron emission regions are formed on the portions of the cathode electrodes exposed through the holes of the insulation layer and the gate electrodes.

In view of the foregoing, the electron emission device of FIG. 1 can be an FEA type electron emission device. However, the invention is not thereby limited. Alternatively, embodiments of the present invention can be an SCE, MIM, MIS, or BSE type electron emission devices, all of which will still fall within the spirit and scope of the present invention.

Referring now still to FIG. 1, a light emission unit is formed at the second substrate 4 facing the first substrate 2. Phosphor layers 20R, 20G, 20B and black layers 22 are formed on the inner surface of the second substrate 4, and an anode electrode 18 covers the phosphor layers 20G, 20R, 20B and the black layers 22. The anode electrode 18 may be formed with metal, such as aluminum. The anode electrode 18 receives the voltage required for accelerating the electron beams, and has a role of increasing the screen brightness by way of a metal back effect.

Alternately, the anode electrode 18 may be formed with a transparent conductive material, such as indium tin oxide (ITO). In this case (not shown), the transparent conductive anode electrode (not shown) is first formed on the second substrate 4, and the phosphor layers 20R, 20G, 20B and the black layers 22 are then formed on the transparent conductive anode electrode. Furthermore, a metallic layer may be formed on the phosphor layers 20R, 20G, 20B and the black layers 22 to increase the screen brightness. The anode electrode (e.g., the anode electrode 18 or the transparent conductive anode electrode) may be singly formed on the entire surface of the second substrate 4 or patterned on the entire surface of the second substrate 4 in a plural manner (i.e., the anode electrode 18 may include a plurality of electrodes on the second substrate 4 in a predetermined pattern).

In addition, the grid electrode 8 is mounted between the first substrate 2 and the second substrate 4 and has a plurality of apertures 6. A plurality of upper spacers (not shown) are mounted in non-pixel regions between the second substrate 4 and the grid electrode 8 to maintain a uniform gap between these elements, and a plurality of lower spacers (not shown) are mounted in non-pixel regions between the first substrate 2 and the grid electrode 8 to maintain a uniform gap between these elements.

In the electron emission device of the embodiment of FIGS. 1, 2A, 2B, and 3, apertures 6 of the grid electrode 8 have a size smaller than a sub-pixel region, and a plurality of the apertures correspond to one sub-pixel region. The apertures 6 of the grid electrode 8 are arrayed (or formed) randomly corresponding to the first substrate 2 and second substrate 4.

As shown in FIGS. 2A and B, the apertures 6 could be formed with a square shape. Additionally, the apertures 6 could have various shapes such as round (refer to FIG. 4), elliptical (refer to FIG. 5), triangular (refer to FIG. 6), hexagonal (refer to FIG. 7). In FIGS. 4, 5, 6, and 7, elements marked 6A, 6B, 6C, and 6D are apertures.

In certain embodiments of the present invention, the grid electrode (e.g., the grid electrode 8) is formed with a thickness of about 10~180 μm. In certain embodiments of the present invention, the thickness of the grid electrode is smaller than the thickness of a conventional grid electrode due to smaller apertures, (i.e., the apertures 6 having a size smaller than a sub-pixel region).

In operation and with the above-described structures, when predetermined driving voltages are applied to the gate electrodes 10 and the cathode electrodes 14, electric fields are formed around the electron emission regions 16, and electrons (or electron beams) are emitted from the electron emission regions 16. The electron beams pass through the apertures 6 and collide against the phosphor layers 20R, 20G, 20B at relevant pixels. The phosphor layers 20R, 20G, 20B are then excited to thereby display the desired images.

In the electron emission device of the exemplary embodiment of FIGS. 1, 2A, 2B and 3, apertures 6 of grid electrode 8 are small and a plurality of apertures 6 of the grid electrode 8 correspond to one sub-pixel region (A). Thus, because the apertures 6 are small, the grid electrode effectively disperses and decreases an anode electric field affecting electron emission regions 16. That is, the grid electrode effectively prevents the anode electric field from affecting electron emission regions 16. As such, the electron emission device improves image quality by preventing unwanted diode emission. Further, a high voltage can be applied to the anode electrode 18.

Table 1 (below) shows electric field intensity measured at the surface of the cathode electrodes as voltage applied to the anode electrodes changes in a conventional electron emission device (Comparative Example) and in an electron emission device of an embodiment of the present invention (Exemplary Example).

In the comparative example, the grid electrode corresponds to one aperture per sub-pixel region, the thickness of the grid electrode is 180 μm and the size of the aperture is 200×400 μm. In the exemplary example, the grid electrode corresponds to a plurality of apertures per sub-pixel region, the thickness of the grid electrode is 40 μm, and the size of the aperture is 40×40 μm. The other structures of both the comparative and exemplary examples are substantially similar. A voltage applied to the gate electrodes of both the comparative and exemplary examples is 200V.

TABLE 1

| | | Electric field intensity measured on the cathode electrodes | |
|---|---|---|---|
| Va (anode voltage, kV) | | Maximum | Minimum |
| Comparative Example | 1 | 1.88 | 1.87 |
| | 2 | 1.90 | 1.90 |
| | 3 | 1.93 | 1.92 |
| | 4 | 1.96 | 1.94 |
| | 5 | 1.99 | 1.97 |
| Exemplary Example | 1 | 1.89 | 1.89 |
| | 2 | 1.90 | 1.90 |
| | 3 | 1.91 | 1.91 |
| | 4 | 1.92 | 1.92 |
| | 5 | 1.93 | 1.93 |
| | 6 | 1.94 | 1.94 |
| | 7 | 1.95 | 1.95 |
| | 8 | 1.96 | 1.96 |

As shown in Table 1, when the voltage of the anode electrode of the comparative example is 3 kV and the voltage of the anode electrode of the exemplary example is 5 kV, electric field intensities of the cathode electrodes are about the same. In addition, when the voltage of the anode electrode of the comparative example is 4 kV and the voltage of the anode electrode of the exemplary example is 8 kV, electric field intensities of the cathode electrodes are about the same. As such, it is possible to apply a higher voltage to the anode electrodes in the electron emission device of the exemplary embodiment as compared to the comparative examples.

The sub-pixel size should be determined with reference to preventing an effect of the anode electric field. In addition, a longest side of the aperture(s) (e.g., the aperture's length if the aperture's width is the same in size or shorter, the aperture's major axis, the aperture's diameter, etc.) should be determined with reference to electron transmissivity.

In particular, the aperture size can be about 5~40% of one sub-pixel size. That is, if the percentage is under 5%, it is difficult to manufacture the apertures (e.g., the aperture 6) due to their small size. Further, it is difficult to maintain strength because the thickness of the grid electrode must be decreased during manufacturing of the apertures with percentage under 5%. On the other hand, if the above percentage is over 40%, diode emission can occur. The diode emission is effectively caused by the anode electric field applied through the apertures on the electron emission regions.

The longest side of the aperture(s) (e.g., the aperture's length if the aperture's width is shorter, the aperture's major axis, the aperture's diameter, etc.) can be about 95-150% of the grid electrode thickness. If the ratio is under 95%, control of diode emission is difficult. If the ratio is over 150%, the brightness will decrease. This is because electrons collide with an inside wall of the apertures such that electron transmissivity decreases.

In view of the foregoing, a grid electrode (e.g., the grid electrode 8) effectively blocks the anode electric field. For example, referring now back to FIGS. 1 and 3, a gap between the first and second substrates 2 and 4 can be shortened, especially a gap between grid electrode 8 and the second substrate 4. In this embodiment, the gap between grid electrode 8 and the second substrate 4 can be about 1~1000 μm, and the gap between the first substrate 2 and the second substrate 4 can be about 200~2800 μm. As the gap between the first and second substrates 2 and 4 is shortened, the cross-sectional area (or profile or size) of the electron beam colliding on phosphor layers 20R, 20G, 20B is decreased.

Figure 8:
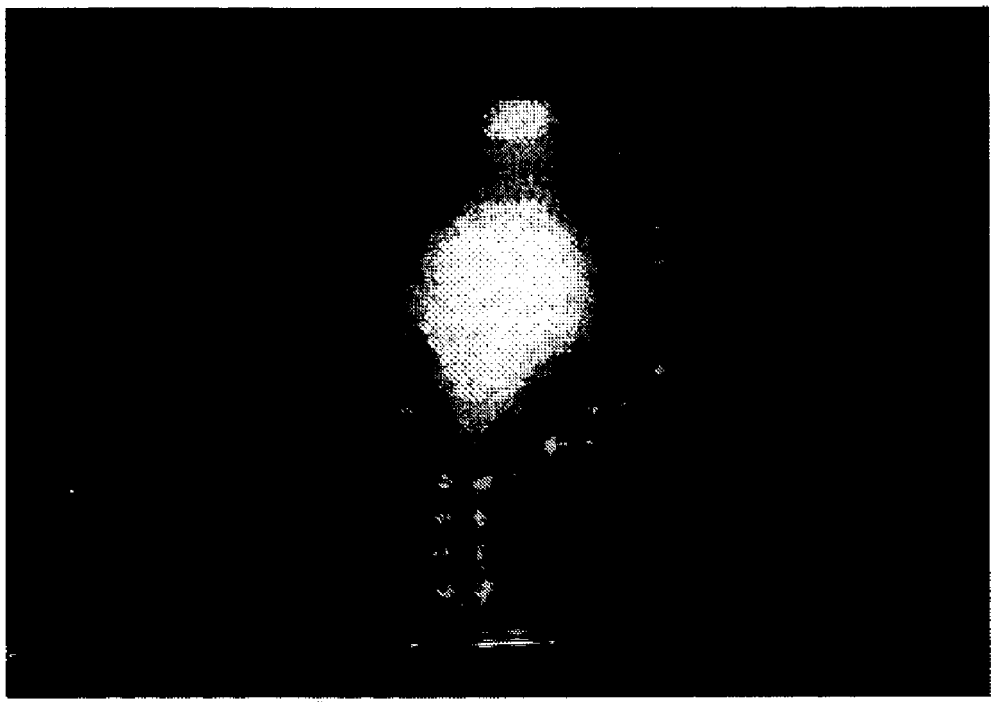
FIG. 8 is a picture of an illuminant pattern on phosphor layers in the conventional electron emission device.
Figure 9:
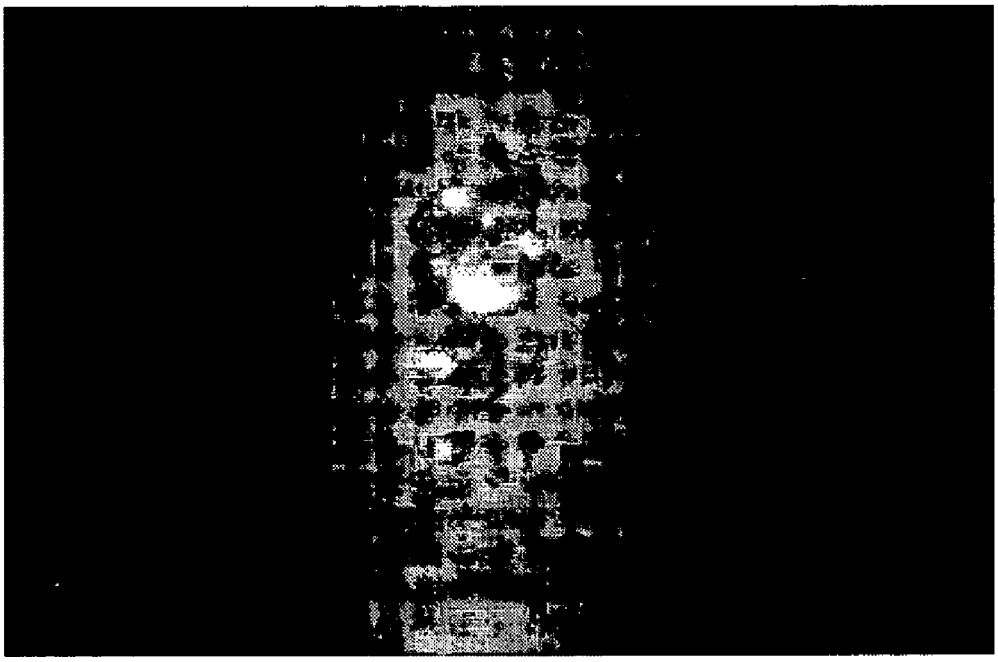
FIG. 9 is a picture of an illuminant pattern on phosphor layers in an electron emission device according to an exemplary embodiment of the present invention.

FIG. 8 is a picture of an illuminant pattern on phosphor layers in the conventional electron emission region. FIG. 9 is a picture of an illuminant pattern on phosphor layers in an electron emission device with the grid electrode according to an exemplary embodiment of the present invention.

For reference, the gap between the first substrate (e.g., the first substrate 2) and the grid electrode (e.g., the grid electrode 8) is about 200 μm in the embodiments of FIGS. 8 and 9. The gap between the second substrate (e.g., the second substrate 4) and the grid electrode is about 1100 μm in the embodiment of FIG. 8, and about 600 μm in the embodiment of FIG. 9. In both embodiments, a positive voltage of about 70V is applied to the gate electrodes (e.g., the electrodes 10), a negative voltage of about 70V is applied to the cathode electrodes (e.g., the electrodes 14), and a positive voltage or about 3 kV is applied to the anode electrode (e.g., the electrode 18). The voltage applied to the grid electrode is maintained at about 5V/μm.

In the conventional electron emission device of FIG. 8, the maximum size of the electron beam is shown to be about 525 μm. In the exemplary embodiment of FIG. 9, the maximum size of the electron beam is shown to be about 387 μm. Namely, the electron emission device of the embodiment of FIG. 9 effectively decreases the size (or cross-section or profile) of the electron beam in comparison with the conventional electron emission device of FIG. 8. A diminution of electron beam size prevents illumination of the wrong pixels. Thus, overall color purity is improved.

In general and in view of the foregoing, an electron emission device of the present invention inhibits diode emission because the grid electrode of the electron emission device interrupts or blocks the anode electric field. As such, a high voltage can be applied to the anode electrode of the emission device. Thereby, brightness of the electron emission device increases, and driving voltages decrease such that lifespan of electron emission regions of the emission device is increased due to a low driving voltage condition.

In addition, the size (or profile or cross-section) of the electron beam colliding on phosphor layers is decreased in an electron emission device of the present invention because the gap between the first and second substrates of the emission device is shortened.

While this invention has been described in connection with certain exemplary embodiment(s), it is to be understood that the invention is not limited to the disclosed embodiment(s), but, on the contrary, is intended to cover various modifications included within the spirit and scope of the appended claims and equivalents thereof.

What is claimed is:

1. An electron emission device comprising:

a first substrate and a second substrate facing each other and having a predetermined distance therebetween;

an electron emission unit formed on the first substrate, the electron emission unit having at least one sub-pixel region;

a light emission unit formed on the second substrate; and a grid electrode mounted between the first and second substrates and having a plurality of apertures for the at least one sub-pixel region, wherein the electron emission unit comprises a gate electrode and a cathode electrode crossing the gate electrode, and wherein the grid electrode is mounted between the light emission unit and the cathode and gate electrodes.

2. The electron emission device of claim 1, wherein the apertures of the grid electrode corresponding to the first and second substrates are formed randomly.

3. The electron emission device of claim 1, wherein the apertures of the grid electrode are formed in a round shape, an elliptical shape, or a polygonal shape.

4. The electron emission device of claim 1, wherein at least one of the apertures has a first size and the at least one sub-pixel region has a second size and wherein the first size is about 5~40% of the second size.

5. The electron emission device of claim 1, wherein a longest side of at least one of the apertures is about 95~150% of a thickness of the grid electrode.

6. The electron emission device of claim 1, wherein the grid electrode is formed with a thickness of about 10~180 μm.

7. The electron emission device of claim 1, wherein the first and second substrates are formed apart at about 200~2800 μm from each other.

8. The electron emission device of claim 7, wherein the second substrate and the grid electrode are formed apart at about 1~1000 μm from each other.

9. The electron emission device of claim 1, wherein the electron emission unit comprises electron emission regions, and wherein the gate and cathode electrodes are for controlling electron emission of the electron emission regions.

10. The electron emission device of claim 9, wherein the gate and cathode electrodes include a plurality of cathode electrodes electrically connected to the electron emission regions and a plurality of gate electrodes insulated from the cathode electrodes.

11. The electron emission device of claim 9, wherein at least one of the electron emission regions comprises a material selected from the group consisting of a carbon nanotube material, a graphite material, a C60 (fullerene) material, a diamond-like carbon material, a graphite nanofiber material, a silicon nano-wire material, and a combination thereof.

12. The electron emission device of claim 10, wherein the gate electrodes cross over the cathode electrodes to form a plurality of sub-pixel regions including the at least one sub-pixel region.

13. The electron emission device of claim 9, wherein at least one of the electron emission regions comprises a carbon-based material.

14. The electron emission device of claim 1, wherein the light emission unit includes at least one anode electrode and phosphor layers formed on one surface of the at least one anode electrode.

15. The electron emission device of claim 14, wherein the at least one anode electrode comprises a material selected from the group consisting of a transparent material and a metal thin layer material.

16. An electron emission device comprising:

an electron emission region;

a cathode electrode coupled to the electron emission region;

a gate electrode crossing over the cathode electrode to form a sub-pixel region;

an anode electrode placed at a predetermined distance facing the cathode electrode;

a plurality of phosphor layers formed on one surface of the anode electrode; and a grid electrode mounted between the cathode electrode and the cathode and gate electrodes and having a plurality of apertures for the sub-pixel region.

17. The electron emission device of claim 16, wherein the cathode electrode and the gate electrode control electron emission of the electron emission region.

18. The electron emission device of claim 17, wherein the anode electrode assists the plurality phosphor layers to receive electrons emitted from the electron emission region.

19. The electron emission device of claim 16, wherein the grid electrode blocks a diode emission caused by a high voltage applied onto the anode electrode and wherein the high voltage applied onto the anode electrode reduces a driving voltage of the electron emission device.

20. The electron emission device of claim 16, wherein the electron emission device is housed within a flat panel display device.

* * * * *

UNITED STATES PATENT AND TRADEMARK OFFICE

CERTIFICATE OF CORRECTION

PATENT NO. : 7,319,287 B2
APPLICATION NO. : 10/999107
DATED : January 15, 2008
INVENTOR(S) : Sang-Hyuck Ahn It is certified that error appears in the above-identified patent and that said Letters Patent is hereby corrected as shown below:

| | |
|---|---|
| Column 8, line 40, Claim 16 | Delete "cathode",<br>Insert --anode-- |

Signed and Sealed this

Second Day of September, 2008

JON W. DUDAS
*Director of the United States Patent and Trademark Office*